United States Patent [19]

Hanrahan et al.

[11] Patent Number: 4,799,357

[45] Date of Patent: Jan. 24, 1989

[54] CLOSED LOOP REGENERATION SYSTEM FOR GENERATING MECHANICAL ENERGY AND THE METHOD THEREFOR

[75] Inventors: Robert J. Hanrahan; Avinash K. Gupta, both of Gainsville, Fla.

[73] Assignee: Solar Reactor Technologies, Inc., Miami, Fla.

[21] Appl. No.: 852,454

[22] Filed: Apr. 16, 1986

[51] Int. Cl.[4] ..... F01K 21/06

[52] U.S. Cl. ..... 60/673; 60/39.461; 60/649; 60/39.465; 422/206; 422/234; 423/487; 423/500; 423/648.1

[58] Field of Search ..... 422/132, 190, 191, 206, 422/234, 235; 423/487, 488, 500, 648 R; 126/263, 271.2 R; 60/39.12, 39.465, 641.8

[56] References Cited

U.S. PATENT DOCUMENTS

| | | | |
|---|---|---|---|
| 3,365,276 | 1/1968 | Childs et al. | 423/648 R |
| 3,919,406 | 11/1975 | Grimes et al. | 423/500 |
| 4,026,112 | 5/1977 | Scragg et al. | 60/641.8 |
| 4,070,861 | 1/1978 | Scragg et al. | 60/39.465 |
| 4,157,380 | 6/1979 | Prahl | 423/488 |
| 4,175,381 | 11/1979 | Scragg et al. | 60/39.12 |
| 4,211,537 | 7/1980 | Teitel | 423/648 R |

*Primary Examiner*—Benoit Castel

*Attorney, Agent, or Firm*—Cushman, Darby & Cushman

[57] ABSTRACT

A closed loop power regeneration system combines chlorine and hydrogen to form hydrogen chloride at high temperatures and pressure. The high temperature, high pressure hydrogen chloride is used to drive a turbine after which the heat from the hydrogen chloride is extracted for use in a regeneration system. The hydrogen chloride is converted to hydrogen and chlorine in the regeneration system. In the regeneration system copper and cuprous chloride react with the hydrogen chloride at a temperature of at least about 200° C. to generate cuprous chloride, cupric chloride and molecular hydrogen. In a second reactor containing cuprous chloride and cupric chloride the extracted thermal energy from the hydrogen chloride is utilized to generate copper, cuprous chloride and molecular chlorine. The molecular chlorine and hydrogen are recombined to form hydrogen chloride in the system. In an alternative embodiment, silver is used as a reagent rather than copper and cuprous chloride.

12 Claims, 3 Drawing Sheets

CLOSED LOOP REGENERATION SYSTEM FOR GENERATING MECHANICAL ENERGY AND THE METHOD THEREFOR

This invention relates generally to an improved closed looped power regeneration system. This is related to application Ser. No. 819,500 entitled "Radiation Augmented Electrolysis Cell for Generating Hydrogen and Oxygen" and application Ser. No. 814,031 entitled "Hydrogen and Oxygen Generation System". It is also related to Ser. No. 804,518 entitled "Solar Augmented Power System" all of which are assigned to the common assignee herewith.

In the past, efforts have been made to generate molecular hydrogen and chlorine for use as primary fuel reagents in a combustion chamber. Such hydrogen and chlorine are combined to form HCl at high pressures and temperatures in order to drive a suitable output device, such as, a turbine. The difficulty has been to recycle the hydrogen chloride efficiently to regenerate molecular hydrogen and chlorine for continuous use in the power system.

In the past as disclosed in Melor's Comprehensive Treatise on Inorganic and Theoretical Chemistry, Volume 3, 1923, pages 80 and 81 and as disclosed in Japanese Patent Publication (Kokai) No. 51-54892, techniques are disclosed for the generation of hydrogen and chlorine from HCl. However, neither reference teaches both the generation of hydrogen and chlorine in a practical system for generating power.

In the aforementioned application, Ser. No. 814,031 entitled "Augmented Power System", a reactor chamber is provided having an input for a reactor material such as a halogen or interhalogen. Radiation is applied to the chamber to disassociate the reaction materials in the chamber and to provide reaction products having high temperatures and pressures. These materials are utilized to generate work such as to drive a turbine with the reacting materials then passing through a heat sink. The reaction materials reassociate to the original reactants and thereafter are stored for recycling. This application does not teach how to generate hydrogen and chlorine from HCl but does teach a method and apparatus for generating power in a closed loop system using halogens or interhalogens.

It is an object of this invention to provide an improved system for efficiently regenerating hydrogen and chlorine for use in a closed loop power system.

SHORT STATEMENT OF THE INVENTION

Accordingly, this invention relates to a method and apparatus for generating hydrogen and chlorine for use in a power system. Molecular hydrogen and chlorine are coupled to a combustion chamber wherein the hydrogen and chlorine combine to form HCl under high pressure and temperatures. The HCl is used to drive a suitable output device such as a turbine for generating mechanical and/or electrical power. The exhaust pipes from the turbine are directed to a heat sink where a substantial remaining portion of the heat of the HCl is removed. The HCl is then coupled to a hydrogen-chlorine regeneration system which includes a pair of reactors. In the first reactor, copper and cuprous chloride are located on beds through which the HCl is passed. The HCl combines with the copper and cuprous chloride to form hydrogen in molecular form and cuprous chloride and cupric chloride. At the same time heat extracted from the HCl after leaving the turbine is coupled to a second reactor containing cuprous chloride and cupric chloride. The heat causes the cuprous chloride and cupric chloride to form copper and molecular chlorine and cuprous chloride and molecular chlorine respectively. The molecular chlorine is then supplied back to the combustion chamber for recombination with the molecular hydrogen. After the cuprous chloride and cupric chloride have been substantially converted to copper and cuprous chloride respectively, the mode of operation has changed such that the hydrogen chloride is coupled to the second reactor to form a hydrogen and cuprous chloride. The heat from the output heat sink of the turbine is coupled to the first reactor to form molecular chlorine and cuprous chloride.

In an alternative embodiment of the invention, silver rather than copper is used as a base material wherein HCl combines with silver to form silver chloride and hydrogen. The silver chloride is then irradiated with light energy to form molecular silver and molecular chlorine. The process then repeats itself on a continuous basis.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
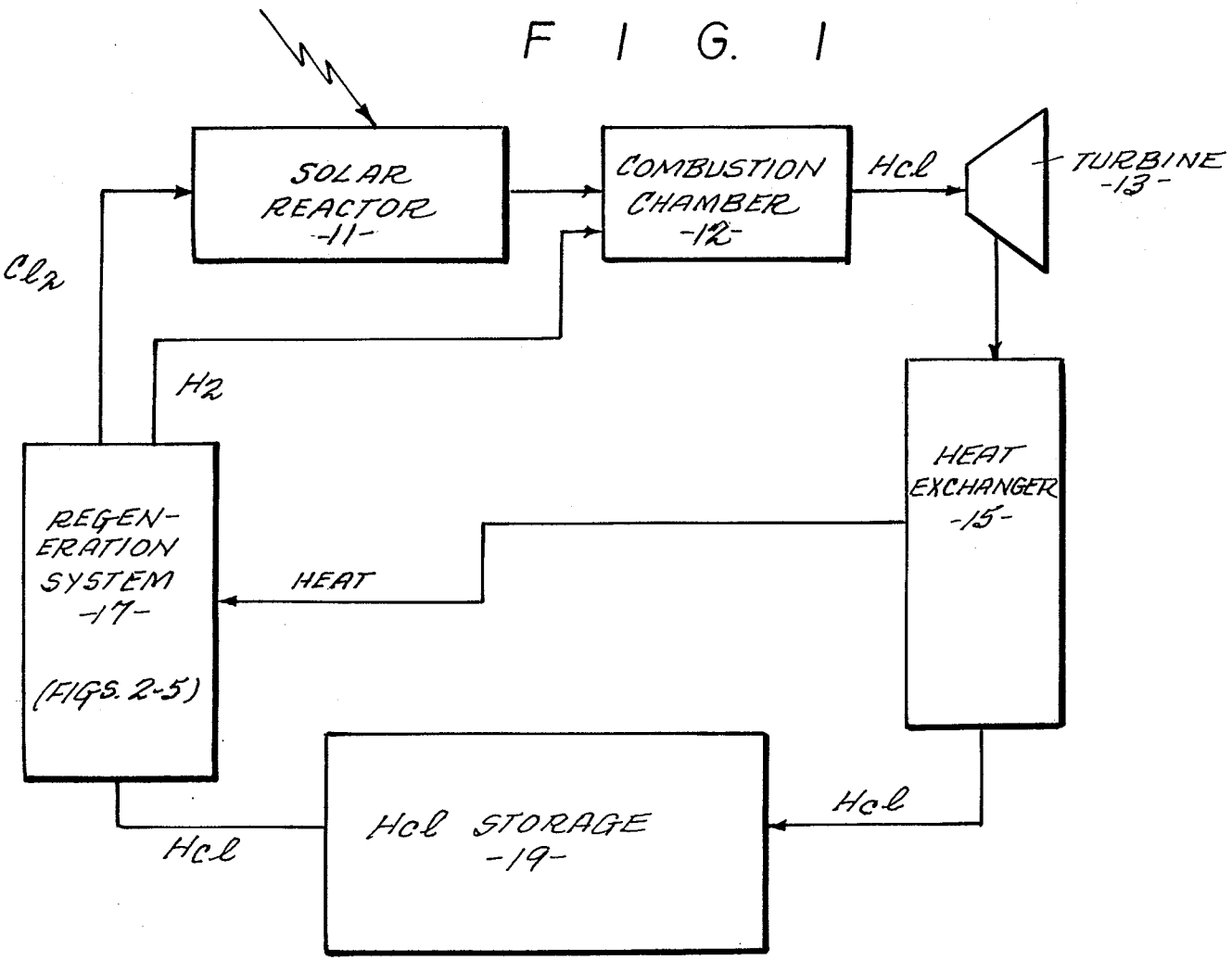
FIG. 1 is a schematic block diagram of the system of the preferred embodiment of the present invention.

Refer now to FIG. 1 which is a schematic block diagram of the preferred embodiment of the system of the present invention. The molecular chlorine is coupled to a solar reactor 11 wherein electromagnetic radiation such as from the sun is directed into the chlorine to excite the chlorine to a higher energy level. The excited chlorine is coupled to a combustion chamber 12 together with molecular hydrogen wherein the hydrogen and chlorine is combined to form a hydrogen chloride. The hydrogen chloride is generated at high temperatures and pressures and is used to drive a suitable output power conversion device such as a turbine 13.

Turbine 13 is utilized to generate mechanical and/or electrical power as desired. The exhaust from the turbine is passed through a suitable heat sink 15 of a type known in the art for cooling the HCl. The heat extracted from the HCl is directed to the hydrogen-chlorine regeneration system 17 which will be described in greater detail hereinbelow. The cooled HCl is coupled to a storage unit 19 or in the alternative may be coupled directly to the regeneration system 17.

In the regeneration system, the HCl is converted back to molecular hydrogen and chlorine for coupling to the solar reactor 11 and the combustion chamber 12.

Figure 2:
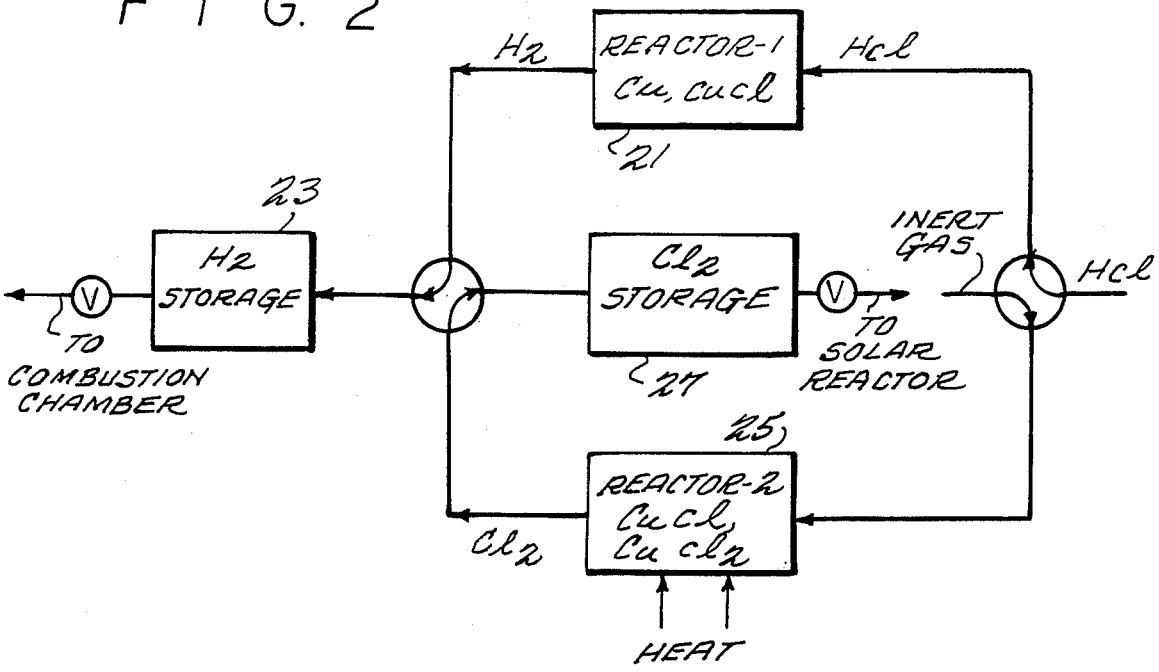
FIG. 2 is a block diagram of the hydrogen-chlorine regeneration system of the preferred embodiment of the present invention when in a first mode of operation.

Refer now to FIG. 2 which is a more detailed block diagram of the regeneration system 17. As illustrated HCl from the storage tank 19 or directly from the heat sink 15 is coupled to the first reactor 21 wherein the HCl passes through beds of copper and cuprous chloride in the first reactor 21. The copper and cuprous chloride is preferably deposited as a refractory material, such as, alumina or a silica gel of porous pellets of, for example, ¼ inch diameter. The following reactions take place in the reactor 21:

$$Cu+HCl \rightarrow CuCl+\tfrac{1}{2}H_2$$

$$Cu+2HCl \rightarrow CuCl_2+H_2$$

$$CuCl+HCl \rightarrow CuCl_2+\tfrac{1}{2}H_2$$

The reactions take place at a preferable temperature of 230° C. but may take place at a temperature of anywhere from 100° C. at the low end up to 400° C. at the upper end.

At the output of the first reactor 21 is molecular hydrogen which is coupled to a hydrogen storage tank or directly to the combustion chamber 12. In the meantime, the copper and cuprous chloride in reactor 21 is converted to cuprous chloride and cupric chloride, respectively. As aforementioned, this reaction preferably takes place in the neighborhood of 230° C. At the same time, heat from the heat sink 15 and from another source such as solar heat is coupled to a second reactor chamber 25. The temperature of the reactor chamber 25 should preferably be in the range of 700° C. to 800° C. but could be as high as 1500° C. In the second reactor chamber 25 are beds of cuprous chloride and cupric chloride. As in the reactor 21, the cuprous and cupric chloride is deposited as a suitable refractory material. Thermal energy from the heat sink and another source (not shown) is directed into this reactor. The cupric chloride is converted to cuprous chloride and chlorine while the cuprous chloride is converted to copper and molecular chlorine, each in accordance with the following reactions:

$$CuCl_2 \rightarrow CuCl+\tfrac{1}{2}Cl_2$$

$$CuCl_2 \rightarrow Cu+Cl_2$$

$$CuCl \rightarrow Cu+\tfrac{1}{2}Cl_2$$

The chlorine thus formed in reactor 25 is coupled to a suitable storage device 27 or directly to the solar reactor chamber 11.

In order to improve the efficiency of the reaction in reactor 25, an inert gas, such as, argon, helium or nitrogen may be passed through the reactor 25 to sweep the chlorine from the beds of cuprous and cupric chloride. In such a case, the chlorine will be mixed with the inert gas at the output of the reactor 25. The inert gas can be separated from the chlorine by techniques known in the art either before the chlorine is coupled to the combustion chamber 12 or thereafter.

Figure 3:
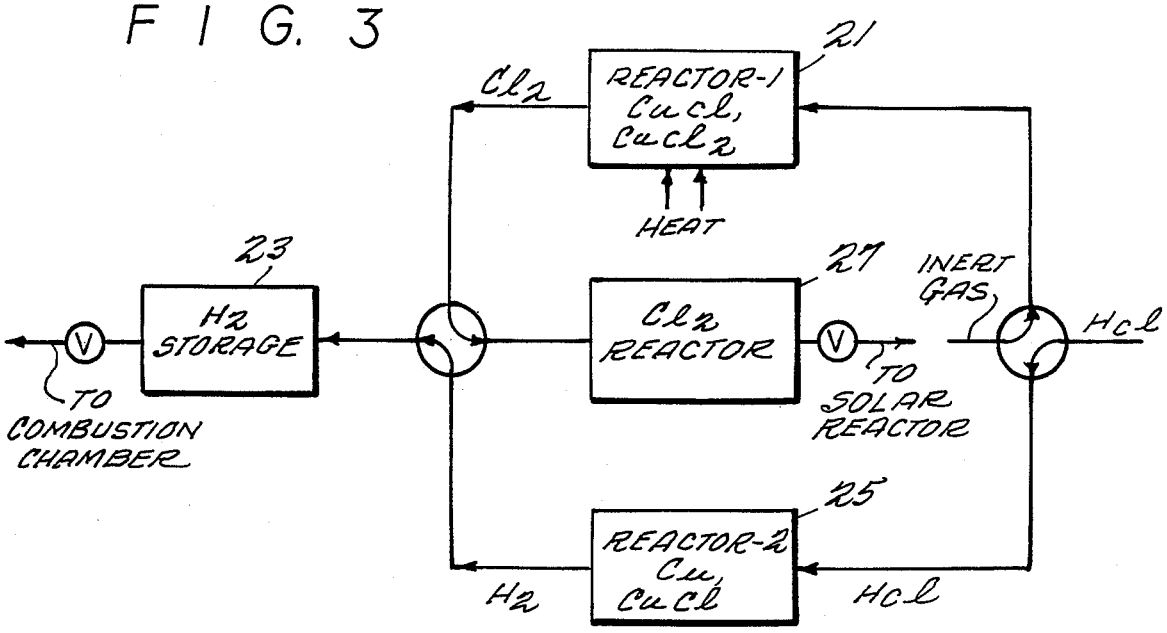
FIG. 3 is a schematic block diagram of the hydrogen-chlorine regeneration system of the preferred embodiment of the present invention when in a second mode of operation.

After a time the cuprous chloride and cupric chloride in the reactor 25 becomes exhausted with only copper and cuprous chloride remaining therein. When this occurs, the system is switched as shown in FIG. 3, such that the incoming HCl from the heat sink is coupled to the second reactor 25 such that the following reactions take place therein:

$$Cu+HCl \rightarrow CuCl+\tfrac{1}{2}H_2$$

$$Cu+2HCl \rightarrow CuCl_2+H_2$$

$$CuCl+HCl \rightarrow CuCl_2+\tfrac{1}{2}H_2$$

At the same time, heat from the heat sink 15 is coupled to the reactor chamber 21 wherein the copper and cuprous chloride therein is converted to chlorine, copper and cuprous chloride in accordance with the following reactions:

$$CuCl_2 \rightarrow CuCl+\tfrac{1}{2}Cl_2$$

$$CuCl_2 \rightarrow Cu+Cl_2$$

$$CuCl \rightarrow Cu+\tfrac{1}{2}Cl_2$$

The chlorine thus generated in reactor 21 is coupled to the storage unit 27 whereas hydrogen formed in the reactor 25 is coupled to the hydrogen storage unit 23 or, as aforementioned, directly to the combustion chamber 12. This process repeats itself as the copper and cuprous chloride is substantially depleted.

Figure 4:
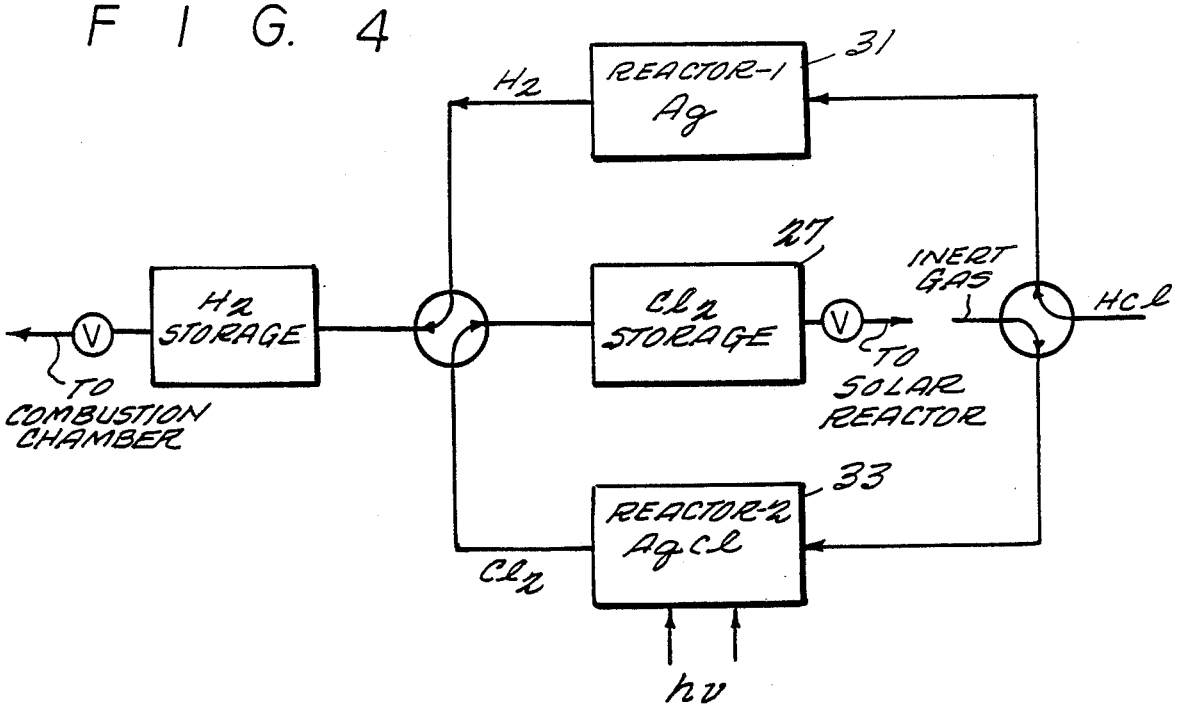
FIG. 4 is an alternative embodiment of the present invention for generating hydrogen and chlorine when in a first mode of operation.
Figure 5:
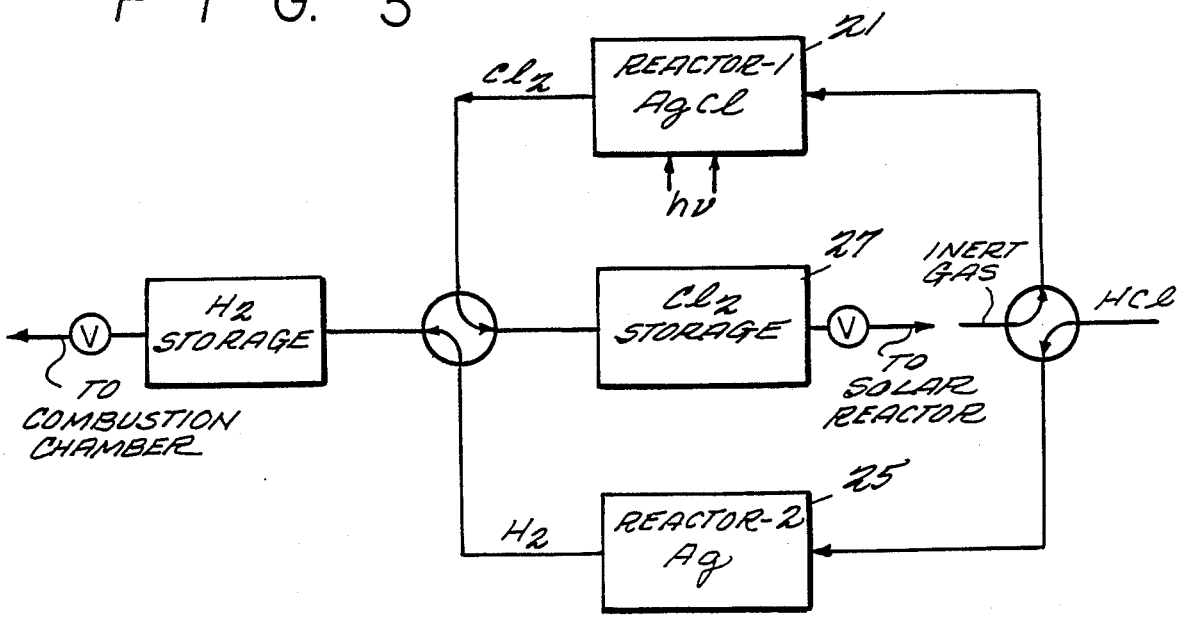
FIG. 5 is an alternative embodiment of the invention for generating hydrogen and chlorine when in the second mode of operation.

In an alternative embodiment of the invention, silver is used as the reactant rather than copper or cuprous chloride. As shown in FIGS. 4 and 5, in the second embodiment, hydrogen chloride is coupled to a reaction chamber 31 having a bed of silver positioned on a suitable refractory material therein. When the hydrogen chloride passes over the silver, silver chloride and molecular hydrogen is formed in accordance with the following reaction:

$$HCl+Ag \rightarrow Ag\,Cl+\tfrac{1}{2}H_2$$

This reaction takes place at a temperature in the range of 150° C. to 400° C. At the same time silver chloride in reactor 33 is converted to silver and chlorine by photons from, for example, a solar flux. Preferably the light energy should be in the range of 300 to 500 nanometers which is in the blue to ultraviolet range. The photons directly disassociate the silver chloride. This reaction takes place as follows at a temperature which should not exceed 220° C.

The silver chloride can thereafter be converted to metallic silver and molecular chlorine by directing suitable electromagnetic radiation thereto in accordance with the following reaction:

$$AgCl+hr \rightarrow Ag+\tfrac{1}{2}Cl_2$$

While this latter reaction involves an expensive reactant, namely, silver the process can operate at lower temperature levels and thus would be more efficient in practice. Whether using silver or copper as a reactant, applicants' invention results in an approved system for generating power by combining HCl to generate high pressure and temperature exhaust products for driving a turbine and for thereafter separating the HCl into molecular hydrogen and chlorine for subsequent recombination.

While the present invention has been disclosed in connection with the prefered embodiment thereof, it should be appreciated that this embodiment can be made in keeping with the present invention.

What is claimed is:

1. A closed loop regeneration system for generating mechanical and thermal energy comprising:

means for combining molecular chlorine and hydrogen to form hydrogen chloride at high temperatures and pressure;

means receiving said hydrogen chloride from said combining means for generating mechanical power;

means for extracting thermal energy from said hydrogen chloride;

means for converting said hydrogen chloride to molecular hydrogen and chlorine; said converting means comprising a first reactor containing copper and cuprous chloride;

means for passing said hydrogen chloride over said copper and cuprous chloride at a temperature of at least about 100° C. to thereby generate cuprous chloride, cupric chloride and molecular hydrogen;

a second reactor containing cuprous chloride and cupric chloride;

means for conveying said thermal energy from said extracting means to said second reactor to thereby generate copper, cuprous chloride and molecular chlorine; and means for conveying said generated molecular chlorine and hydrogen to said combining means.

2. The closed loop regeneration system of claim 1 further comprising conduit means for flowing said hydrogen chloride to said second reactor and said extracted thermal energy to said first reactor; and valve means for controlling said hydrogen chloride flow to said second reactor and said extracted thermal energy flow to said first reactor when said cupric chloride in said second reactor is substantially depleted or when said copper in said first reactor has been substantially converted to cuprous or cupric chloride.

3. The closed loop regeneration system of claim 1 further comprising storage means for storing said hydrogen and chlorine and conduit means connected to said conveying means for conveying said hydrogen and chlorine to said storage means.

4. The closed loop regeneration system of claim 1 further comprising means for storing said hydrogen chloride after it has been passed through said thermal energy extracting means and means connected to said extracting means for conveying said hydrogen chloride to said means for storing.

5. A closed loop regeneration system for generating mechanical and thermal energy comprising;

means for combining molecular chlorine and hydrogen to form hydrogen chloride at high temperature and pressures;

means receiving said hydrogen chloride from said combining means for generating mechanical power;

means for extracting thermal energy from said hydrogen chloride; and means for converting said hydrogen chloride to molecular hydrogen and chlorine; said converting means comprising;

a first reactor containing silver;

means for passing said hydrogen chloride over said silver at a temperature of at least about 150° C. to thereby generate silver chloride and molecular hydrogen;

a second reactor containing silver chloride;

means for conveying said extracted thermal energy from said extracting means to said second reactor to thereby generate silver and molecular chlorine; and means for conveying said generated molecular chlorine and hydrogen to said combining means.

6. The closed loop regeneration system of claim 5 further comprising conduit means for flowing said hydrogen chloride to said second reactor and said extracted thermal energy to said first reactor; and valve means for controlling said hydrogen chloride flow to said second reactor and said extracted thermal energy flow to said first reactor when said silver chloride in said second chamber is substantially depleted or when said silver in said first reactor has been substantially converted to silver chloride.

7. The closed loop regeneration system of claim 5 further comprising storage means for storing said hydrogen and chlorine; and means connected to said converting means for conveying said hydrogen and chlorine to said storage means.

8. The closed loop regeneration system of claim 5 further comprising means for storing said hydrogen chloride after having its energy extracted therefrom and means connected to said extracting means for conveying said hydrogen chloride to said means for storing.

9. In a closed loop regeneration system for generating mechanical and thermal energy, a method of regenerating the reactants therein comprising the steps of:

combining molecular chlorine and hydrogen to form hydrogen chloride at high temperatures and pressure;

receiving said hydrogen chloride for generating mechanical power;

extracting thermal energy from said received hydrogen chloride;

converting said hydrogen chloride to molecular hydrogen and chlorine by the following steps;

passing said hydrogen chloride over copper and cuprous chloride in a first reactor at a temperature of at least about 200° C. to thereby generate cuprous chloride, cupric chloride and molecular hydrogen;

conveying said extracted thermal energy to a second reactor containing cuprous chloride and cupric chloride to thereby generate copper, cuprous chloride and molecular chlorine; and conveying said generated molecular chlorine and hydrogen to a means for combining the molecular chlorine and hydrogen to form hydrogen chloride.

10. The method of claim 9 further comprising the step of conveying said hydrogen chloride to said second reactor and said extracted thermal energy to said first reactor when said cuprous chloride in said second reactor is substantially depleted or when said copper in said first reactor has been substantially converted to cuprous or cupric chloride.

11. In a closed loop regeneration system for generating mechanical and thermal energy, a method of regenerating the reactants therein comprising the steps of:

combining molecular chlorine and hydrogen to form hydrogen chloride at high temperatures and pressure;

converting said formed hydrogen chloride to mechanical power;

extracting thermal energy from said formed hydrogen chloride; and converting said hydrogen chloride to molecular hydrogen and chlorine in accordance with the following steps;

passing said hydrogen chloride over silver in a first reactor at a temperature of at least about 150° C. to thereby generate silver chloride and hydrogen;

conveying said extracted thermal energy to a second reactor containing silver chloride to thereby generate silver and chlorine; and conveying said generated chlorine and hydrogen to a means for combining said chlorine and hydrogen to form hydrogen chloride.

12. The method of claim 11 further comprising the steps of conveying said hydrogen chloride to said second reactor and said extracted thermal energy to said first reactor when said silver chloride in said second chamber is substantially depleted or when said silver in said reactor has been substantially converted to silver chloride

* * * * *